United States Patent [19]

Botsch

[11] 4,184,957

[45] Jan. 22, 1980

Best Available Copy

[54] SCREENING APPARATUS FOR REMOVING COARSE MATERIAL FROM FLUIDS INCLUDING A SCREEN CLEANER

[76] Inventor: Bertram Botsch, Albtalstr. 13, D-7-500 Karlsruhe, Fed. Rep. of Germany

[21] Appl. No.: 843,826

[22] Filed: Oct. 20, 1977

[30] Foreign Application Priority Data

Oct. 21, 1976 [DE] Fed. Rep. of Germany ..... 2647539

[51] Int. Cl.[2] ..... C02C 1/22; B01D 35/28

[52] U.S. Cl. ..... 210/155; 209/385; 210/159

[58] Field of Search ..... 209/250, 268, 353, 355, 209/357–361, 385–390, 324, 326, 261, 316, 317; 210/332, 334, 335, 357, 159, 162, 155; 55/295, 296; 134/6

[56] References Cited

U.S. PATENT DOCUMENTS

| | | | |
|---|---|---|---|
| 2,106,851 | 2/1938 | Nordell | 210/155 |
| 2,671,563 | 3/1954 | Benner | 210/159 |
| 2,897,967 | 8/1959 | Arthur | 210/155 |
| 3,909,411 | 9/1975 | Angele et al. | 210/159 |
| 4,042,506 | 8/1977 | Wilson | 210/155 |

FOREIGN PATENT DOCUMENTS

| | | |
|---|---|---|
| 905118 | 2/1954 | Fed. Rep. of Germany . |
| 2304600 | 10/1974 | Fed. Rep. of Germany . |

*Primary Examiner*—Frank W. Lutter
*Assistant Examiner*—Jon E. Hokanson
*Attorney, Agent, or Firm*—Ernest F. Marmorek

[57] ABSTRACT

A pair of screens are arranged one behind the other and served by a common cleaning rake for the removal of the screenings from both screens in a single operating step.

14 Claims, 7 Drawing Figures

SCREENING APPARATUS FOR REMOVING COARSE MATERIAL FROM FLUIDS INCLUDING A SCREEN CLEANER

FIELD OF THE INVENTION

The present invention relates to a screening system for the removal of coarse material from fluids having a first arrangement for the retaining of the coarse material therein and a second arrangement for removing the collected screenings or coarse materials from the fluid. Such screening systems are usually employed in the intake structure of sewage treatment plants, cooling water intake structures etc., in order that the fluid could be supplied to the individual processing stages next following without the presence of disturbing coarse materials therein.

BACKGROUND OF THE INVENTION

Multi-stage screening arrangements are constructed usually in such a manner that several screening units are arranged behind each other and usually each unit includes a device for the retaining of the coarse material, that is, a screen or similar arrangement, and a device for the removal of the coarse material, that is, an up and down movable or continuously movable screen cleaner, as well as device for transporting away the coarse material resulting from the screening. In order words, the required equipment outlay of a multi-stage screening arrangement is usually proportional to the number of the stages present. Such large structural outlay affects equally the space, machine-technical, control technical, the operating and service technical and costs considerations as well.

In the screening arrangement according to German Laid-Open Application No. 2,304,600 and German Pat. No. 905,118 the large structure is simplified in that the screening devices are set up with a distance with respect to each other and are cleaned one after the other by a single cleaning arrangement. This known arrangement still requires a great deal of mechnical outlay. In addition, the time element required for the cleaning is twice as large as required for the cleaning of a single screen.

German Pat. No. 44,143 discloses uncleaned screens which are set up behind each other with a distance following each other as a second stage for the additional retention of coarse material.

SUMMARY OF THE INVENTION

It is, therefore, an object of the present invention to provide an improved screening arrangement for the cleaning and removal of coarse material from fluids which novel screening arrangement will eliminate the shortcomings of the known prior art and at the same time, operates with less mechanical equipment.

It is another object of the present invention to provide a screening arrangement of the above noted type in which the cleaning of the screen is performed simultaneously with a single cleaning arrangement thereby reducing the time required for the cleaning of the screens.

The foregoing and other objects of the present invention will become apparent as the following description proceeds and features of novelty which characterize the invention will be pointed in particularity in the claims affixed to and forming a part of this specification.

Briefly, according to the present invention, a multi-stages cleaning arrangement is provided in which a device for the retention of the coarse material comprises a pair of screen means disposed behind each other at a short distance and wherein the device for the removal of the coarse materials includes a screen cleaning arrangement having a rake means which is constructed to protrude at least through one of the screen means and to remove the coarse materials from both screens in a single operating movement.

BRIEF DESCRIPTION OF THE DRAWING

The present invention will become more readily apparent from the following description of preferred embodiments thereof shown in the accompanying drawings, in which.

DESCRIPTION OF THE PREFERRED EMBODIMENTS

Figure 1:
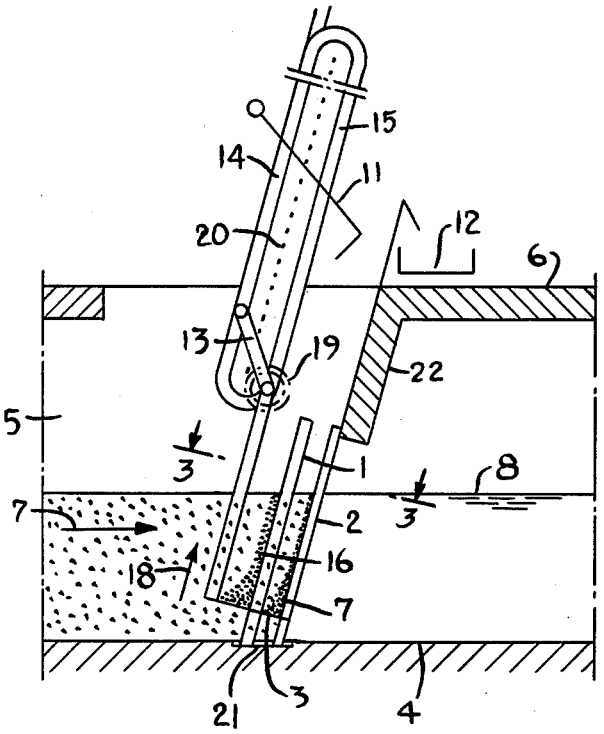
FIG. 1 illustrates in a schematically represented longitudinal cross-section the screening arrangement according to the present invention having the rake means protruding from the upstream side of the flow direction into the screen means.
Figure 2:
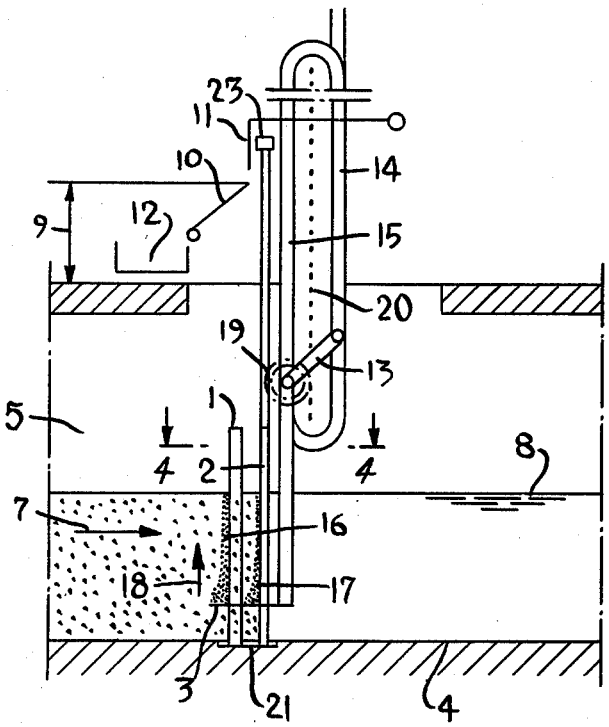
FIG. 2 is a similar illustration of the screening arrangement, as in FIG. 1, showing here the rake means protruding into the screen means in a direction opposite the direction of the flow of the fluid.

With reference to FIGS. 1 and 2, it is seen that the fluid 7 flows in a channel 5 through a pair of screen means 1 and 2 which are disposed with a small distance behind each other. As a result of placing the screens 1 and 2 into the fluid 7, the coarse material which is contained in the fluid 7 will be retained on the screens 1 and 2 and form there the screenings 16 and 17. The screen means 1 and 2 are anchored on the bottom of the channel 4 by means of an anchoring device 21 and protrude upward freely and lean against an apron portion 22 of the service floor 6 of the plant structure as illustrated in FIG. 1 or point upward and structurally are secured by a crossbeam 23 as illustrated in FIG. 2, particularly above the dumping point for the screenings.

The cleaning of screens 1 and 2 itself is performed a known manner by means of a screen cleaning arrangement. Such arrangement comprises a cleaning carriage 13 to which a rake means 3 is coupled in a journalled fashion. The operating movement of the rake means 3 is illustrated as being affected by the cleaning carriage 13 moving in a straight path 14 and over an oval path 15. In the illustrated example of the drive means for the cleaning carriage 13 it is seen that the drive occurs over a driving pinion 19 and a gear rack 20. Such drives are well known in the art where the construction of the guide tracks 14 and 15 will impart the upward operating movement for the rake and a downward reentry trip for it including the hanging of the screens in the illustrated positions.

As illustrated in FIG. 1 the rake 3 protrudes through the first screen 1 and into the second screen 2 in the flow direction of the fluid 7. When the rake device 3 is moved upward in the cleaning direction 18, then the rake 3 will strip the screenings 16 from screen means 1 as well as the screenings 17 from screen 2 and removes them above the surface of the fluid 8 along the apron 22 upward. Above the service floor 6 there is provided a stripping device 11 which will strip the screenings from the rake 3 and dumps it into a disposal container 12.

With reference to FIG. 2 it is seen that the rake device 3 will protrude through the second screen 2 as well as through the first screen 1 in a direction opposite to the flow of the fluid 7 and strips off the screenings 16 and 17 during its upward movement in the direction 18 from the screens 1 and 2. Also in this case the screenings are moved above the surface 8 of the fluid upwardly and are brought to a dumping point where the stripping device 11 will strip off the screenings from the rake 3 so that they fall onto the inclined chute 10 and down into a disposal container 12. It is within the scope of the present invention to vary the dimensional proportions according to the desired dumping height 9. It is also within the scope of the invention to provide other drive systems such as ropes or chains irrespective whether driven upwards or downwards or in a continuous fashion.

Figure 3:
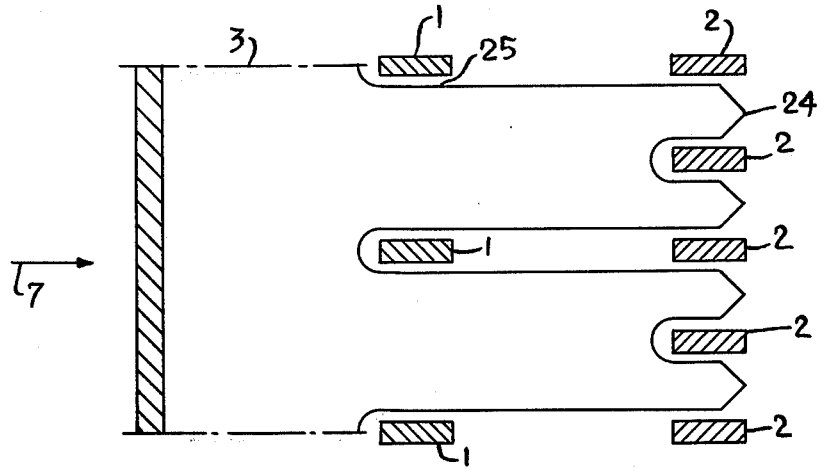
FIG. 3 is a schematic plan view, partly in section, taken on the line 3—3 of FIG. 1, of the rake means intermeshing with the screen means, where the rake means is located on the upstream side of the first screen, as in FIG. 1.

In FIG. 3, there is shown the rake device 3, with a plurality of teeth 24/25. The portion of the rake 3 intermeshing with the second screen 2 has more teeth 24 than the portion 25 of the rake intermeshing with the first screen 1. In this figure, the rake 3 engages the first screen 1 from the upstream side 7, and protrudes through the first screen 1 and into the second screen 2.

Figure 4:
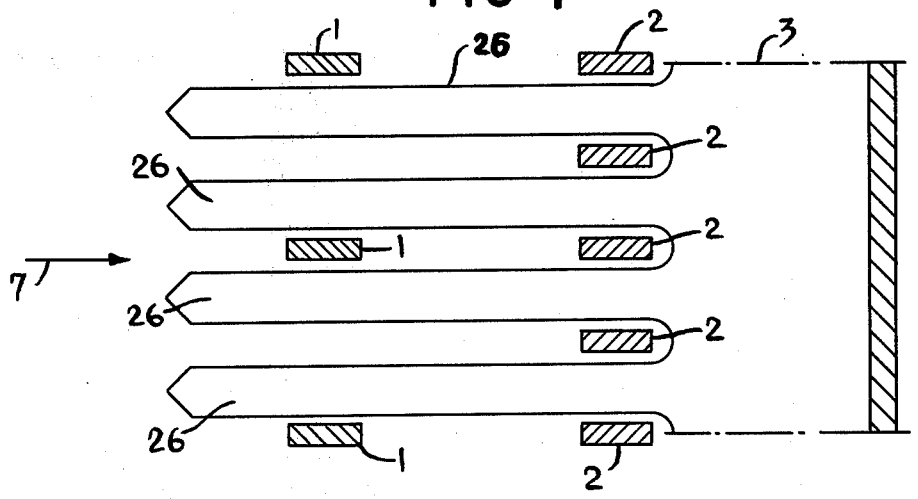
FIG. 4 is a schematic plan view, partly in section, taken on line 4—4 of FIG. 2, of the rake means intermeshing with the screen means, where the rake means is located on the downstream side of the second screen, as in FIG. 2.

In FIG. 4, the rake 3 is seen engaging the second screen 2 from the downstream side with the teeth 26 of the rake 3 protruding through the second screen 2, and the first screen 1.

Figure 5:
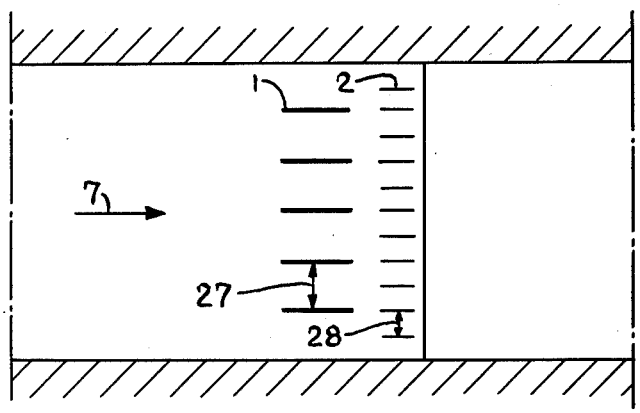
FIG. 5 is a schematic plan view of the screen means.

FIG. 5 shows the spatial relationship between the first screen 1 and the second screen 2, with respect to the flow direction 7. The bar spacing 27 of the first screen 1 is greater than the bar spacing 28 of screen 2. The height of the first screen 1 is less than the height of the second screen 2.

Figure 6:
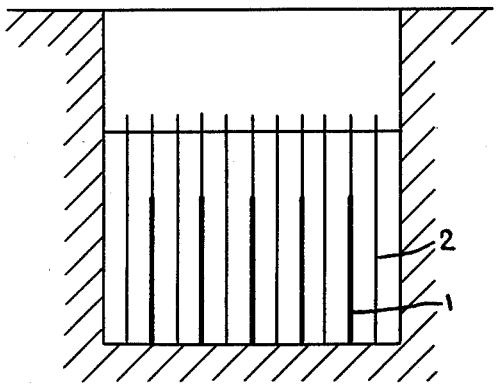
FIG. 6 is a schematic front elevational view of the screen means, as seen in direction 7 of FIG. 5.

FIG. 6 shows the alignment and spacing of the bars in the first and second screens 1 and 2, respectively.

Figure 7:
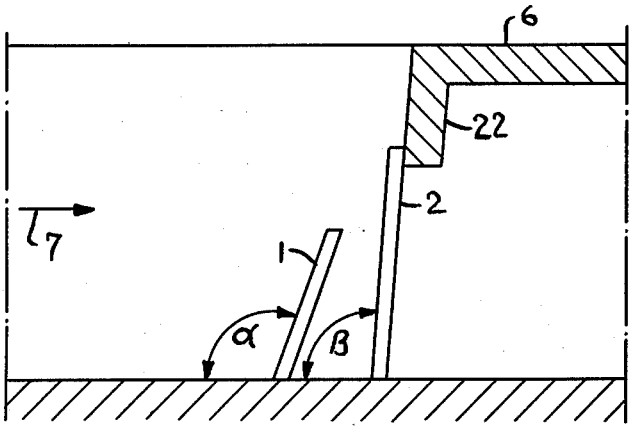
FIG. 7 is a schematic vertical sectional view similar to FIG. 1, but embodying a modification in which the first and second screens both are inclined with respect to the flow direction, and with respect to each other.

FIG. 7 shows the inclincation of the two screens 1 and 2, the first screen being inclined at an angle $\alpha$, ranging from about 60° to about 80°, and the second screen is inclined at an angle $\beta$, ranging from about 80° to 90°, with respect to the flow direction 7. The second screen 2 is shown leaning against an apron portion 22 of the service floor 6.

As can be seen from the above it is within the scope of the invention to provide a double stage screening arrangement with a mechanical and control layout which formerly has been required for a single stage screening arrangement as far as the auxiliary equipment is concerned excepting the screens themselves and operated as before a single stage unit has been operated.

One will also appreciate the special advantage of the present invention flowing from the construction and the arrangement of the screens 1 and 2 themselves. In the case of a freely upwardly protruding first screen 1 in Figure 1, the stripped screenings 16 are moved beyond the end of the screen bars upwardly without letting them falling back into the channel. Even in the case of a differential head, caused by the blockage of the screen 1 and a subsequent submerging of the first screen 1 there is no danger that the screenings 16 will be swept through the arrangement into the stream behind the second screening means 2 in FIG. 2 as screen 2 extends further up. Also according to the present invention the first screen means 1 can serve as an overload protection of the entire screening arrangement as a certain screening quantity will load the two screens to a lesser degree than it would load a single screen. From this follows a further advantage in the case of very deep screening apparatus having long cleaning paths and consequently large cleaning periods, wherein the invention provides a more reliable safety feature against overloading in that during a normal operation larger quantities of the screenings can be removed on the longer path by the raking arrangement according to the present arrangement.

In the event the first screen 1 will reach up only to about the average fluid level, then there is a better reserve available against blockage in the event high fluid levels are present as both screens are better accessible.

In the event the bars of at least the second screen 2 of FIG. 2 reach above the highest fluid level then a reliable obstructing of the fluid by the screens is achieved. In the event the bars of the screens 2 of FIG. 2 reach up to the dumping height, then according to the present invention they can be secured with each other by a cross head 23.

In order to attain the retention of a large quantity of screenings, it is preferred according to the present invention to provide the bar spacing of screen 2 finer or closer than that of screen 1.

In addition it is preferred according to the present invention that when the rake 3 is protruding from the direction of the flow, the teeth of the rake 3 should correspond to the respective screen into which it protrudes. More particularly, in the front portion the rake teeth will correspond to the bar spacing of the second screen and in the back portion it will correspond to the bar spacing of the first screen. In this case first screen means the nearest at protrusion.

In addition, the invention also provides that the first screen due to the much coarser size of the screening which become deposited on it is inclined more than the second screen, more particularly, the first screen 1 is inclined at an angle $\alpha$, ranging from about 100° to about 120°, while the second screen 2 is inclined at an angle $\beta$, ranging from about 90° to about 100°. The angles Alpha ($\alpha$) and Beta ($\beta$) are inclined with respect to the flow direction 7.

I wish it to be understood that I do not desire to be limited to the exact details of construction shown and described, for obvious modifications will occur to a person skilled in the art.

Having thus described the invention, what I claim as new and desire to be secured by Letters Patent, is as follows:

1. A screening apparatus for use in removing coarse materials from a fluid flowing in a channel, comprising screen means including a first screen and a second screen, said first and second screens being disposed one behind the other with respect to the direction of the flow of the fluid, mounting and cleaning means for cleaning said screen means by removing screenings therefrom, and for mounting said screen cleaning means with respect to said first and second screens, said screen cleaning means intermeshing with said first and second screens for removing simultaneously the screenings from both screens.

2. The screening apparatus as claimed in claim 1, wherein each of said screens comprises a plurality of substantially perpendicular bars with respect to the flow and wherein said bars of at least one of said screens is secured on the bottom of the fluid channel.

3. The screening apparatus as claimed in claim 2, wherein said channel has a fluid level therein and said screen bars of said first screen have a length extending beyond the level of said fluid.

4. The screening apparatus as claimed in claim 2, wherein said channel has a fluid level therein including a highest level and said screen bars of said second screen have a length extending beyond the highest fluid level.

5. The screening apparatus as claimed in claim 4, wherein said screen bars of said second screen have a length extending beyond the fluid level to a point where the removed screenings are being dumped by said screen cleaning means.

6. The screening apparatus as claimed in claim 2, wherein said screen bars of said second screen are arranged with respect to each other with a smaller distance therebetween than the distance between the respective screening bars of said first screening means.

7. The screening apparatus as claimed in claim 1, wherein said screen cleaning means is located on the upstream side of said first screen, and wherein said cleaning means comprises a rake having a plurality of teeth, said rake in the portion thereof engaging said second screen has at least as many teeth as in the portion intermeshing with said first screen means.

8. The screening apparatus as claimed in claim 1, wherein said first screen is inclined at a larger angle with respect to the flow direction than said second screen.

9. The screening apparatus as claimed in claim 8, wherein said first screen is mounted to incline at an angle from about 100° to about 120°, and said second screen is mounted to incline at an angle from about 90° to about 100° with respect to the flow direction.

10. The screening apparatus as claimed in claim 1, wherein said first and second screens are anchored on the bottom of the fluid channel, said channel having a fluid level therein, said first screen has a free end and is fixed to a portion of a service floor and said first and second screens extend beyond said fluid level.

11. The screening apparatus as claimed in claim 1, wherein said screen cleaning means is located on the downstream side of said second screen and wherein said screen cleaning means comprises a rake having teeth which protrude through said second and first screens.

12. The screening apparatus as claimed in claim 1, wherein said cleaning means comprises a driving means and a lifting means operably coupled to said screen cleaning means, said lifting means operable to move about a continuous track means having an upwardly and a downwardly directed section, said sections being coupled at both ends with a curvilinear transition section to provide for continuous travelling of said lifting means about said sections, said screen cleaning means when said lifting means is moving along one of said sections being moved upwardly in an operating path and removing the screenings from both of said first and second screen means during such upward moving operating path and moving said screenings up to a dumping point, means for engaging said screen cleaning means at said dumping point for stripping the screenings therefrom, said lifting means when moving downwardly in the other of said sections lowering said screen cleaning means near the bottom of said channel and when passing through the lower one of said curvilinear transition sections causing said screen cleaning means to reenter through said first and second screen means.

13. The screening apparatus as claimed in claim 12, wherein said rake protrudes through said first and second screens from the downstream side of the screen means.

14. The screening apparatus as claimed in claim 12, wherein said first and second screens are anchored on the bottom of the channel, the screen bars of said second screen extending to the height of the dumping point and wherein a cross head means is arranged for securing together the screen bars of said second screen means.

* * * * *